US005517209A

United States Patent [19]

Holland et al.

[11] Patent Number: 5,517,209

[45] Date of Patent: May 14, 1996

[54] WINDOWING SYSTEM WITH INDEPENDENT WINDOWS OF ARBITRARY RESOLUTION FOR DISPLAY ON MULTIPLE DEVICES OF ARBITRARY RESOLUTION

[75] Inventors: Shannon Holland, Palo Alto; Konstantin Othmer, San Jose, both of Calif.

[73] Assignee: Apple Computer, Inc., Cupertino, Calif.

[21] Appl. No.: 437,051

[22] Filed: May 9, 1995

Related U.S. Application Data

[63] Continuation of Ser. No. 59,635, May 10, 1993, abandoned.

[51] Int. Cl.[6] ..... G09G 5/14

[52] U.S. Cl. ..... 345/119; 345/132

[58] Field of Search ..... 345/118, 119, 345/120, 123, 132, 127, 121; 395/128, 131, 157

[56] References Cited

U.S. PATENT DOCUMENTS

| | | | |
|---|---|---|---|
| 4,559,533 | 12/1985 | Bass et al. | 345/120 |
| 4,567,515 | 1/1986 | Schumacher . | |
| 4,712,185 | 12/1987 | Aoki | 364/518 |
| 4,814,884 | 3/1989 | Johnson et al. | 345/120 |
| 4,823,108 | 4/1989 | Pope | 345/120 |
| 4,914,607 | 4/1990 | Takanashi et al. | 345/120 |

FOREIGN PATENT DOCUMENTS

| | | | |
|---|---|---|---|
| 0105707 | 4/1984 | European Pat. Off. | G06F 15/20 |

OTHER PUBLICATIONS

Artwick "Microcomputer Displays, Graphics, and Animation" 1985, pp. 38–44.

Munsch, P. et al., "HP IVI Application Program Interface Design", Hewlett–Packard Journal, 41 (1990) Oct., No. 5, Palo Alto, CA, US, pp. 21–31.

*Primary Examiner*—Richard Hjerpe
*Assistant Examiner*—Regina Liang
*Attorney, Agent, or Firm*—Greg T. Sueoka

[57] ABSTRACT

An independent windowing system that eliminates gridding comprises a method for performing windowing operations directly in device space for a graphics system which specifies all drawings in coordinate space. The re-sizing effects of rendering an object in different places on the coordinate grid are absorbed in the window borders, allowing the window contents to be moved without re-drawing them. The window can be moved without re-drawing it even when the resolution of the device the window is displayed in differs from the source resolution of the rendering system. Furthermore, window contents are drawn relative to the coordinate of the top left of the window to provide each window with its own device grid independent of the window position on the device. The present invention includes: a method for displaying a window that adjusts the window border to eliminate gridding; a method for rendering multiple, overlapping windows that eliminates gridding; and a method for scrolling a finite coordinate grid independent of resolution of the display device. These methods can be used alone or in combination to greatly enhance the graphic images displayed on a display device.

15 Claims, 7 Drawing Sheets

WINDOWING SYSTEM WITH INDEPENDENT WINDOWS OF ARBITRARY RESOLUTION FOR DISPLAY ON MULTIPLE DEVICES OF ARBITRARY RESOLUTION

RELATED APPLICATIONS

This is a continuation of application Ser. No. 08/059,635 filed on May 10, 1993, abandoned.

BACKGROUND OF THE INVENTION

1. Field of the Invention

The present invention relates generally to methods for displaying graphic images on a display device. In particular, the present invention relates to a computer implemented method for rendering a graphic image to a display device that compensates for the resolution of the display device. Still more particularly, the present invention relates to a method for rendering a plurality of overlapping windows on a display device that compensates for the resolution of the display device.

2. Description of the Related Art

Present day graphic systems typically provide a "source space" that refers to the source resolution that defines an image. An image is defined in terms of global and/or local coordinates of the source space. The coordinate system that defines an image may either be local or global. "Global space" refers to a global coordinate space (encompassing many other coordinate spaces) that is at source resolution. "Local space" is a coordinate space that is contained within global space that is also at source resolution. It's coordinate space is local to a referenced point in global space. The computer under user direction manipulates and edits an image by changing various parameters of the image in global and/or local coordinates. After the computer has performed all the desired manipulations on the graphic image, the image is rendered upon a display device by converting the image definition from source space into "device space." "Device space" refers to the pixel resolution of the device upon which the image is being rendered. There may be a one to one correspondence between device space and source space (i.e., the same resolution is used in source space as in device space), however, in some cases, the source space must be mapped to device space using a mapping function that accounts for the differences in the resolutions between the source space and device space.

One problem in rendering a graphic image to a display device is gridding. Gridding occurs when mapping an image defined in one resolution to a second different resolution. Images are conventionally defined by specifying the extents and bounds of the image in source space units of the local or global coordinate system. When the image is rendered on the display device, a region containing the image is transformed from source units of the local or global coordinate system to device units or pixels of the display device. The diagram shown in FIG. 1 illustrates the transformation from a source space of 72 dots per inch (dpi) to a device space of 128 dpi. The rounding or truncation function determines how the gridding will take place. As shown in FIG. 1, a source unit is mapped either to one device pixel or two device pixels. For example, source pixel 3 maps to a single device pixel, pixel e, while the adjacent pixel 4 maps to two device pixels f and g. The source unit could be mapped to even more pixels depending on the difference between the resolution of the source space and the device space. The detrimental effects of gridding become even more apparent when considering rendering a line six source units in length. As shown, if the line is drawn from pixel 1 to 6 of source space, the line has a length of 11 pixels from pixels a through k when rendered in device space. If a line of the same length is drawn at pixel 4 to 10 of source space, the length of the line in device space is 12 pixels from f–q. Therefore, the same length line in source space can have different lengths in device space depending on where the line is positioned. This gridding creates problems since the size of windows and other images on the display device change size depending on their position on the display device.

Another problem with graphics systems of the prior art is that the ownership of device pixels is dependent on whether the source space uses local or global coordinates. As illustrated in FIGS. 2A and 2B, the device pixel(s) that corresponds to a particular source pixel varies depending on whether global or local gridding is used. Both FIGS. 2A and 2B show the mapping of ten pixels of source space to seventeen device pixels for a change in resolution from 72 dpi in source space to 128 dpi in device space. In the global space of FIG. 2A, pixel 2 is represented by two device pixels c and d. However, as shown in local space of FIG. 2B, the same pixel 2 is represented by a single device pixel c. The differences in ownership of device pixels is problematic because it prevents the fast transfer of images from off screen to on screen. Because of the differences, many images defined in global coordinates must be translated and processed before display on the screen. This problem of device pixel ownership being dependent on the use of local or global coordinates is particularly problematic for windowing systems. Windows often only cover a portion of the screen of the display device, and therefore their contents are defined in local coordinates. The window border is defined in global coordinates However, the screen background is in global coordinates. Thus, there is conflict over the ownership of device pixels. This conflict is heightened by the fact that the display device can and very often does present a plurality of windows that overlap each other. The overlap of windows adds more competition for the ownership of pixels by two local spaces that have different offsets from global space. Therefore, there is need for a system and method that eliminates the problems with multiple overlapping windows and their local spaces.

Another problem with windowing systems of the prior art is the requirement that the window and its contents be re-drawn each time the window is moved. The prior art must re-draw both the window border and the window contents each time the window is moved. Since windows are generally defined in local coordinates, they must be re-drawn to the coordinate grid of the display device each time the window is moved. This re-drawing process consumes much of the computer's resources, and can slow down the operation of the computer. Moreover, constant display updates are displeasing for the user. Therefore, there is need for a windowing System that eliminates the overhead associated with moving a window.

Some graphic display methods use the origin of the window on a display device as a reference point for performing drawing operations. The window maintains the same device grid independent of its location on the screen of the display device. To scroll the window contents in such an environment requires that the origin of the window be moved in unison with the scrolling operation. Since the origin of the window is limited to the bounds of the coordinate space defined by the graphics system, which is typically a smaller local space, the size of the data that can be scrolled within the window is limited to graphic coordinates as boundaries. Therefore, there is a need for a method that maintains the integrity of the device grid and removes the graphic coordinates as boundaries. Furthermore, when individual windows have their own gridding independent of the global grid, interactions between the windows occur since there is a question of ownership between pixels on the boundary of where the windows overlaps one and another.

Therefore, there is need for methods of resolving the above gridding problems introduced by multiple origins and varying resolutions.

SUMMARY OF THE INVENTION

The present invention overcomes the limitations and shortcomings of the prior art with an independent windowing system. The independent windowing system comprises a method for performing windowing operations directly in device space for a graphics system which specifies all drawings in source space. The re-sizing effects of rendering an object in different places on the coordinate grid are absorbed in the window borders, thereby allowing the window contents to be moved without re-drawing them. The window borders must be re-drawn, however, the contents can simply be copied. With the present invention, the window can be moved without re-drawing it even when the resolution of the device the window is displayed in differs from the source resolution of the rendering system. Furthermore, window contents are drawn relative to the coordinate of the top left of the window to provide each window with its own device grid independent of the window position on the device. The present invention includes: a method for displaying a window that adjusts the window border to eliminate gridding; a method for rendering multiple, overlapping windows that eliminates gridding; and a method for scrolling a finite coordinate grid independent of resolution of the display device. These methods can be used alone or in combination to greatly enhance the graphic images displayed on a display device.

The method for displaying a window that adjusts the windows border to eliminate gridding preferably comprises the step of: defining the window border in global coordinates; defining the window contents in local coordinates of source space; defining a visible region in global coordinates; mapping the window border from global coordinates to a device grid; drawing the window border on the screen; mapping a visible region from global coordinates of source space to the device grid; mapping the window contents from local coordinates of source space to the device grid; trimming the map of the window contents in device space to match the visible region in device space; and then drawing the trimmed window contents.

DETAILED DESCRIPTION OF THE PREFERRED EMBODIMENTS

Figure 1:
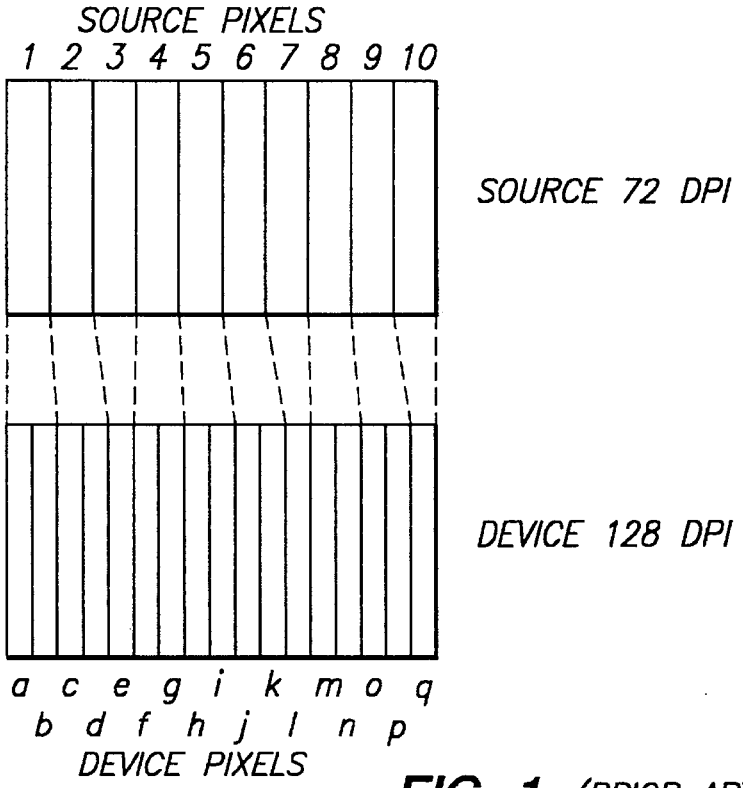
FIG. 1 (PRIOR ART)
FIG. 1 is a graphic representation of the prior art mapping of an image from source space to device space.
Figure 2A:
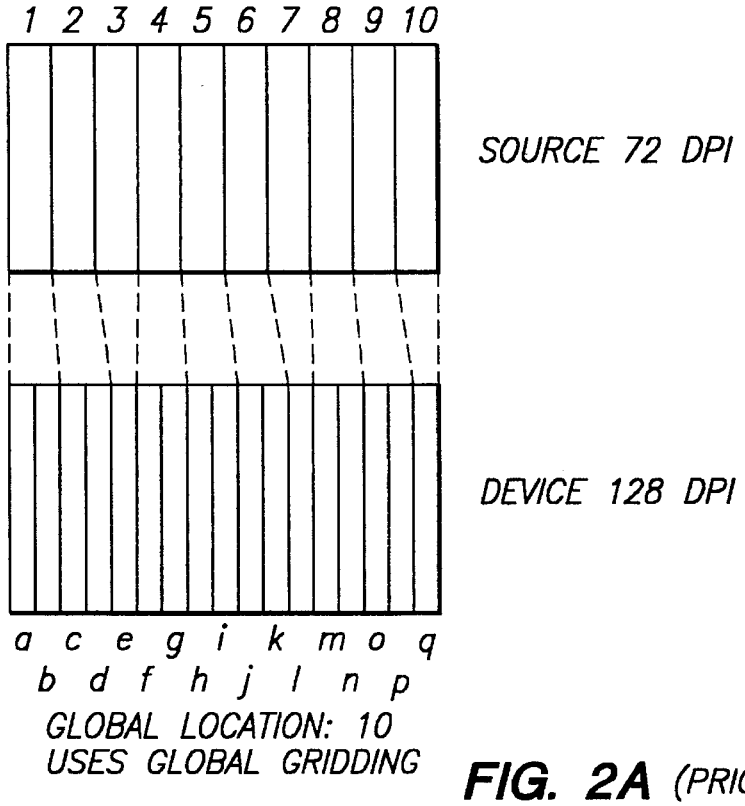
FIG. 2A (PRIOR ART)
FIG. 2A is a graphic representation of the prior art mapping of an image from global source space to device space.
Figure 2B:
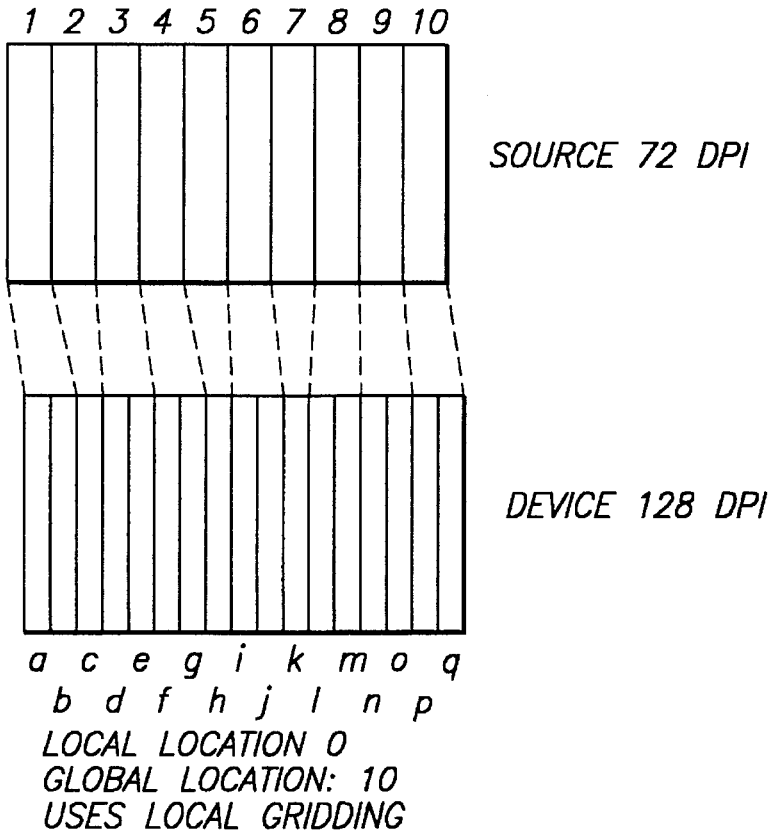
FIG. 2B (PRIOR ART)
FIG. 2B is a graphic representation of the prior art mapping of an image from local source space to device space.
Figure 3A:
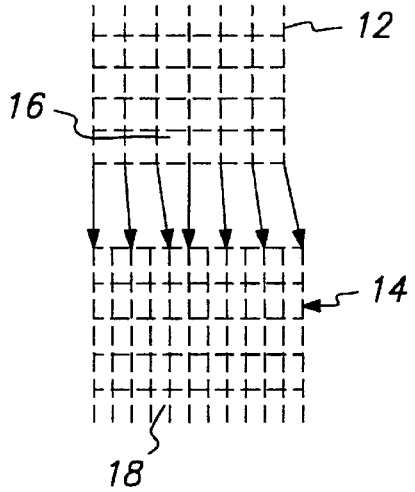
FIGS. 3A and 3B are graphic representations of the mapping of source pixels to device pixels and the mapping of a window in source pixels to device pixels, respectively.
Figure 3B:
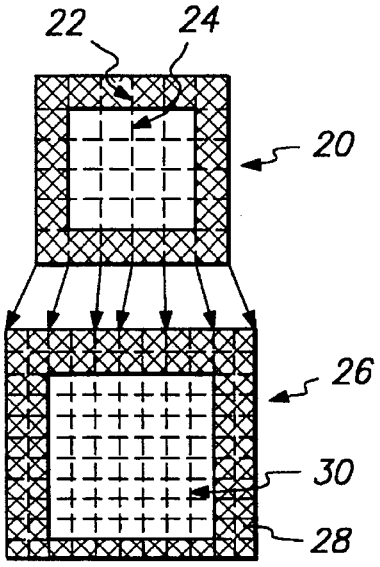

Referring now to FIGS. 3A and 3B, the manner that the present invention overcomes the effects of gridding on a windowing system is shown. For the description of the preferred embodiment of the present invention, global coordinates are defined as being at the same resolution as source space. FIG. 3A illustrates a portion of the source pixel grid 12 to device pixel 14 grid mapping for the horizontal pixels. For this example, the source space is 72 dots per inch (dpi), and the device space is 128 dpi. The mapping is the same for the vertical pixels. This is similar to the mapping shown in FIG. 1. As can be seen, most of the source pixels map to two device pixels, however, a third source pixel 16 maps to only a single device pixel 18. FIG. 3B illustrates a window 20 in accordance with the present invention that is defined in the source pixels grid and how it will be rendered on the screen on the device pixel grid 14. The window 20 preferably includes a border 22 and contents 24 over the source space pixel grid 12. As shown, the window 20 is mapped to a device space window 26 that similarly is comprised of a border 28 and contents 30. The mapping to device pixel grid 14 demonstrates how the position of the window can affect its appearance. When the window 26 is positioned as shown in FIG. 3B, the borders, in particular the left side border, are generally two device pixels in width. However, as each window is moved in global coordinates, the gridding of the frame changes in device space. If the window 26 were to be move three global pixels to the right, the left border of the window 26 would be reduced in half. As shown in FIG. 3B, this gridding phenomenon is shown by the difference between the top border and the bottom border. Because of the location of the window 26, the top border is two pixels high versus the bottom border that is a single pixel high. Thus, the effects of gridding on the contents of the window are eliminated with the present invention by absorbing the effects of gridding in the borders, thereby, keeping the size and relative gridding of the contents the same regardless of the window position, and eliminating the need to re-draw them.

Figure 4:
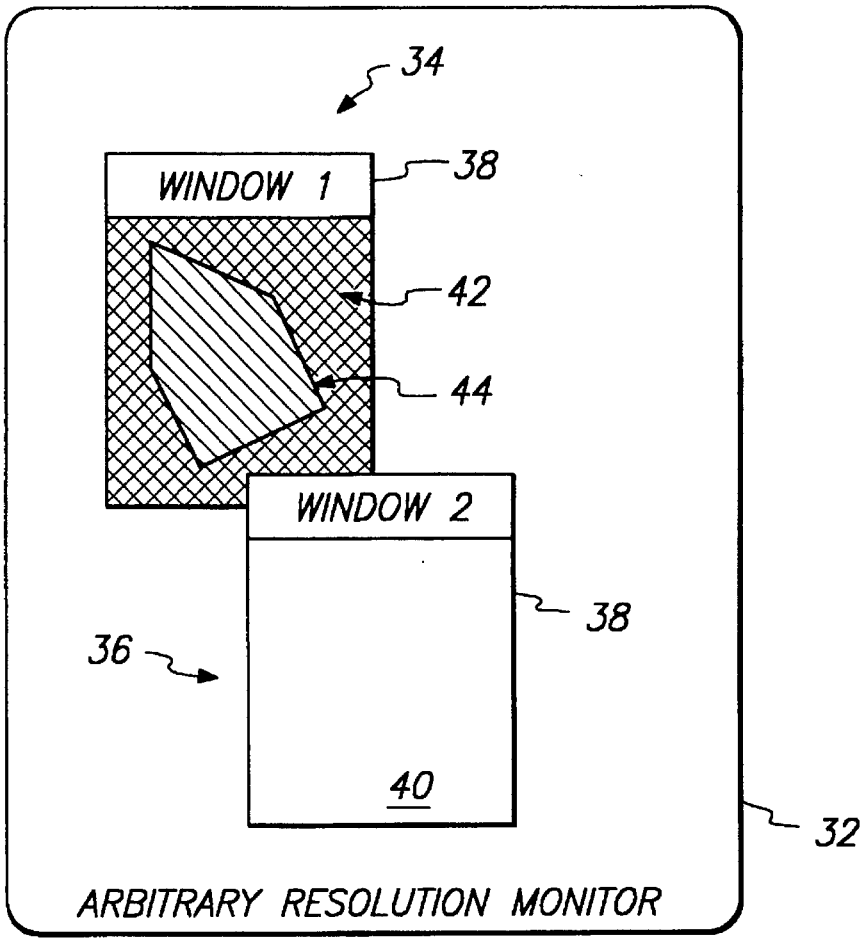
FIG. 4 is a graphic representation of a screen display with a second window overlapping a first window.

Referring now to FIG. 4, the definition of windows in accordance with the present invention will be described. FIG. 4 illustrates a screen 32 of the display device showing a first and a second windows 34, 36. The present invention advantageously reduces the effects of gridding on the windowing system for both individual windows and multiple windows overlaid upon each other. The present invention achieves this result by defining each window 34, 36 as including a window border 38, window contents 40, a visible region 42 and a clip region 44. The window border 38 preferably comprises the rectangular frame surrounding the window contents 40 and defines the size of the window 34, 36. The border 38 is preferably defined in global coordinates of a global device grid. For example, the border 38 may be specified in 72 dpi global coordinates. The window border 38 may also include a title as shown in FIG. 4. The window contents 40 are the image that is to be displayed. The window contents 40 are preferably defined in local coordinates of local device grid relative to the global coordinates of the border 38. For example, the contents 40 may be specified in port resolution local coordinates. While the window border 38 is mapped to the global device grid, the window contents 40 are mapped to a local grid. This means that there may be overlap between the two grids (i.e., there may be contention for a device pixel between a content's local grid and the global grid of the window border 38). The present invention eliminates this contention through a region called the visible region 42. The visible region 42 is defined in global coordinates, and delineates the content pixels of a window 34, 36 that are visible. Any drawing to a window's contents is clipped to this visible region 42 at the device level. This means that drawing to a window 34, 36 is clipped to its visible pixels in device space using a source space global grid. Drawing to the window 34, 36 is accomplished through use of the clip region 44 by application programs. The clip region 44 like the contents is specified in local coordinates, for example, in port resolution local coordinates. Because the window contents 40 are drawn relative to the port, they stay the same wherever the window 34, 36 is positioned. The difference between the gridding in the old window position and the new position is taken up in the window's borders 38. Thus, if a window (whose bounds are specified in 72 dpi in global space) is moved on a 128 dpi monitor, the window borders 38 may change from being represented by one or two device pixels (depending on position); but the contents 40 never change.

Figure 7:
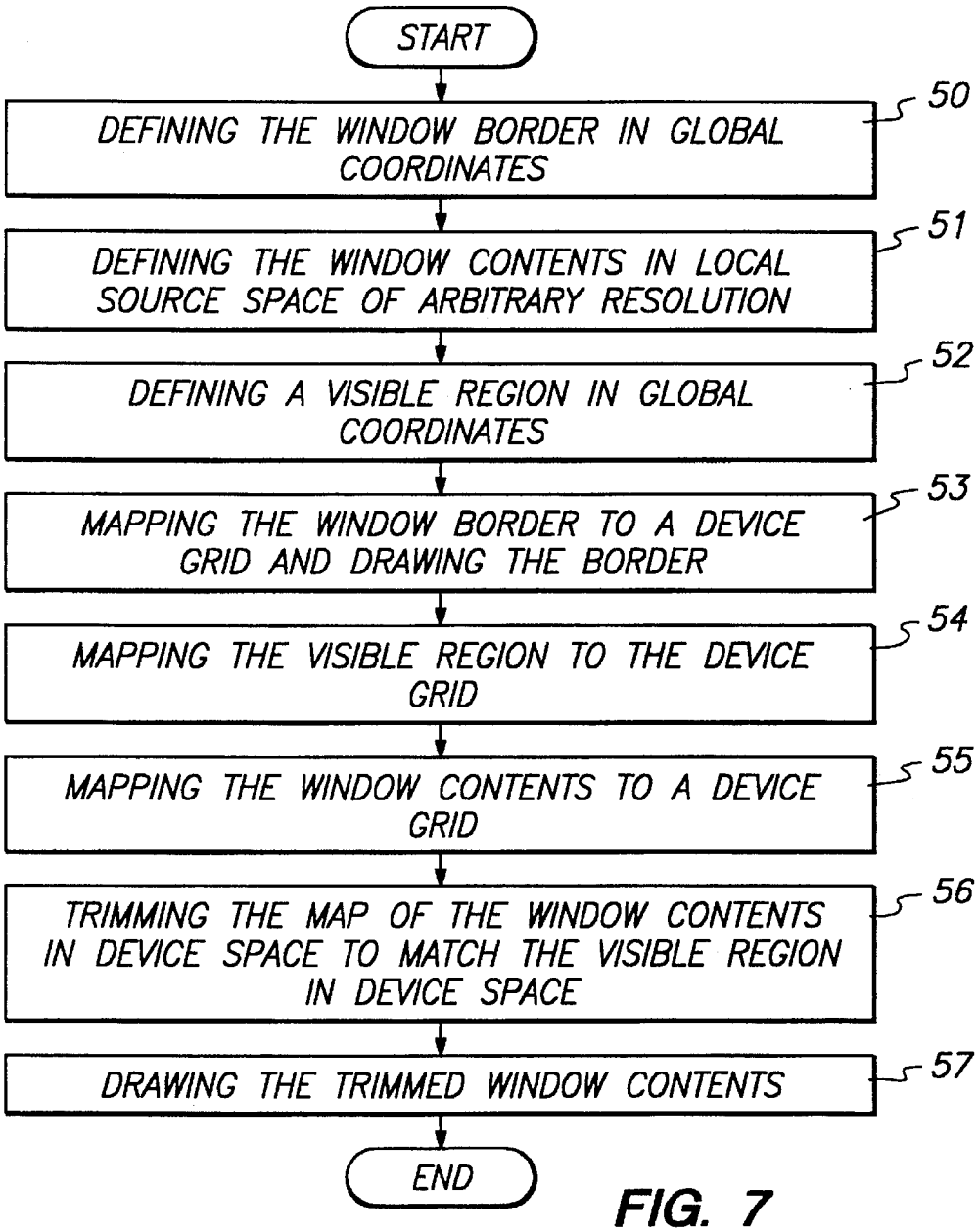
FIG. 7 is a flow chart of the preferred method for rendering a resolution independent window in accordance with the present invention.

Referring now to FIG. 7, the preferred method for displaying a window using system of the present invention will, be described. The preferred method begins in step 50 by defining the window border 38 in global coordinates. The method then in step 51 defines the window contents 40 in local coordinates of source space at any arbitrary window resolution. In step 52, the method defines the visible region 42 in global coordinates. Then in step 53, the window border 38 is mapped from global coordinates to a device grid, and the window border 38 is drawn on the screen 32. Next in step 54, the visible region 42 is mapped from global coordinates to the device grid. The method then maps the window contents 40 from local coordinates of the window source space to the device grid in step 55. In step 56, the method trims the map of the window contents 40 in device space to match the visible region 42 in device space. The window contents 40 are trimmed by identifying those device pixels outside the bounds of the visible region 42. Any such pixels are eliminated to create the trimmed window contents. The trimmed window contents are then drawn on the screen in step 57, and are guaranteed to be without competition for the device pixels because both the visible region 42 and the border 38 are defined in global coordinates.

Figure 5A:
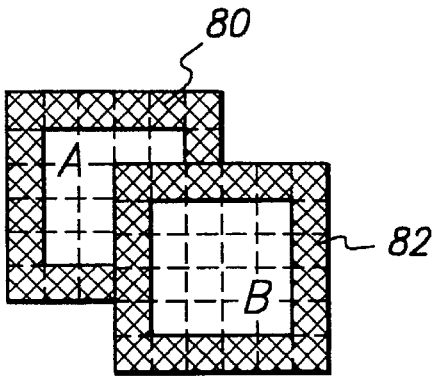
FIGS. 5A and 5B are graphic representations of a first and a second overlapping windows mapped to source pixels and device pixels, respectively.
Figure 5B:
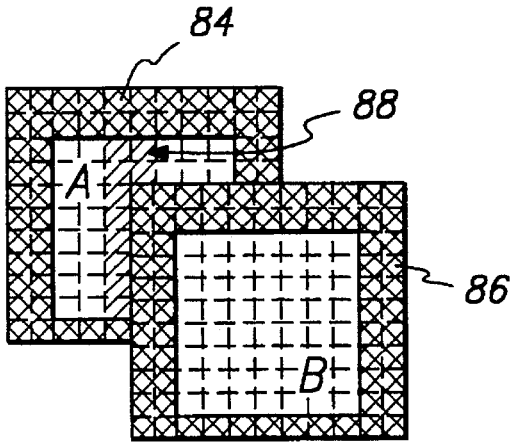

Referring now to FIGS. 5A and 5B, the gridding problem with multiple layered windows can be seen. FIG. 5A shows a first and second windows 80, 82 in source global space. The second window B 82 may cover a first window A 80 as shown in FIG. 5A. However, since each of the windows 80, 82 is traditionally defined in local coordinates, there may be contention for device pixels because of gridding. FIG. 5B show the mapping from global space of the first and second windows 80, 82 which yields a first and second device space windows 84, 86. Since each window's contents have their own coordinate grid, the left edge of window B 86 splits a pixel 88 that previously was owned by window A's contents 84. This contention for device pixel creates appearance problem for the window images.

The system of the present invention also includes a method for rendering multiple overlapping windows. If one window is covered by another, the present invention preferably removes the area covering the window from the visible region of the window underneath. This prevents the covered window from overdrawing any pixels that the top window owns, and eliminates the problems caused by device pixel contention.

Figure 8A:
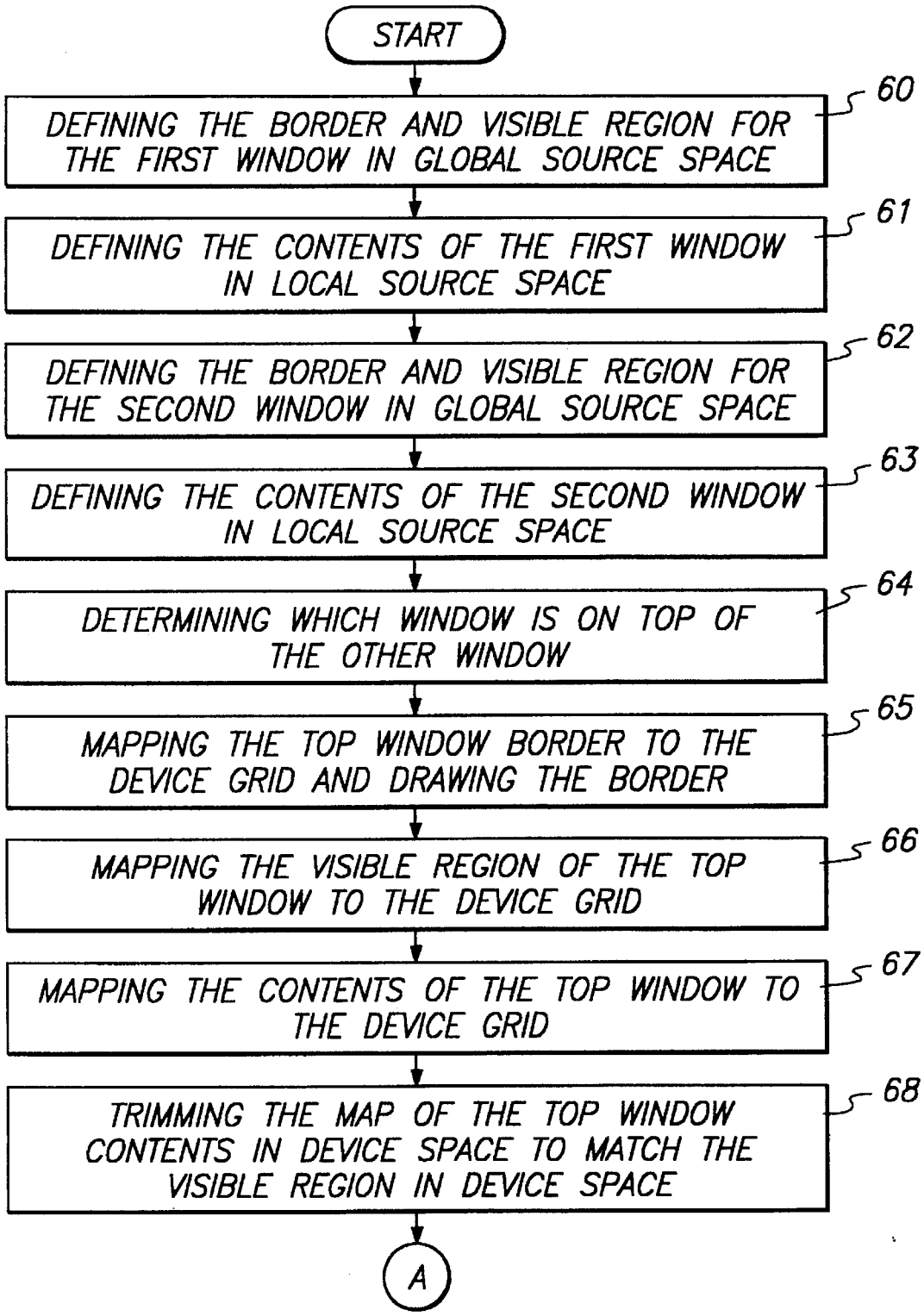
FIG. 8A and 8B are a flow chart of the preferred method for rendering multiple, overlapping resolution independent windows in accordance with the present invention.
Figure 8B:
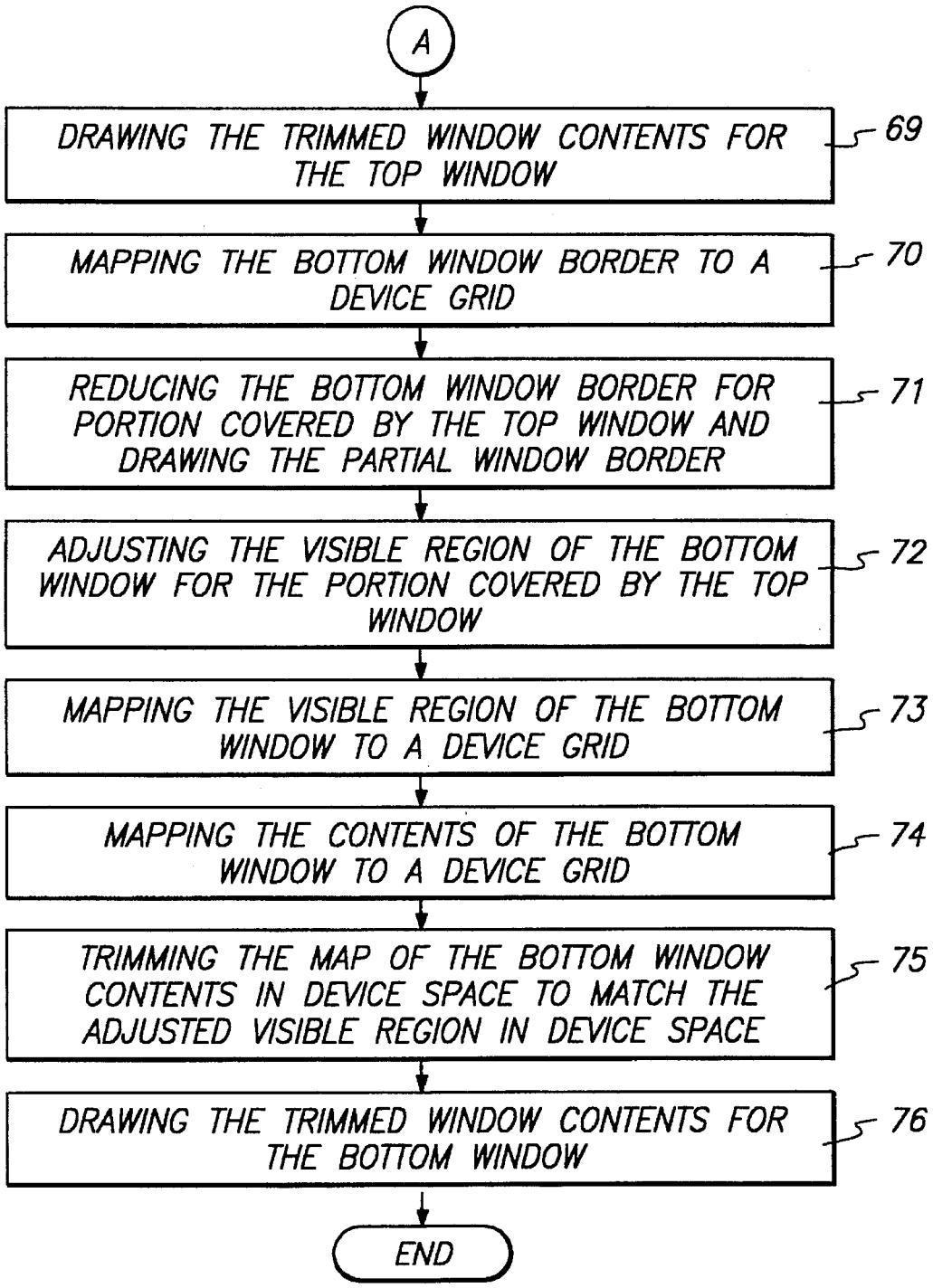

Referring now to FIGS. 8A and 8B, the preferred embodiment of the method for rendering multiple, overlapping, with independent windows to eliminate gridding in accordance with the present invention will be described. The method begins by defining a first and second windows in source space similar to the method for a single window. In step 60, the border and visible region for the first window are defined in global space. In step 61, the method defines the contents of the first window in local space. Next in step 62, the process defines the border and visible region for the second window in global space. The contents of the second window are defined in local space in step 63. Then the method determines which window is on top of the other in step 65. The top window can be drawn as normal using similar steps as described above with reference to FIG. 7. The preferred method maps the border of the top window from global coordinates of source space to a device grid, and draws the border on the screen in step 65. Next in step 66, the visible region of the top window is mapped from global coordinates to the device grid. The method then maps the contents of the top window from local coordinates to the device grid in step 67. In step 68, the method trims the results of step 67 in device space to match the visible region in device space. The trimmed window contents for the top window are then drawn on the screen.

Figure 6A:
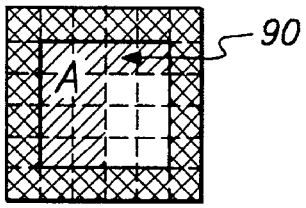
FIGS. 6A and 6B are graphic representations of a the second window mapped to source pixels and device pixels, respectively.
Figure 6B:
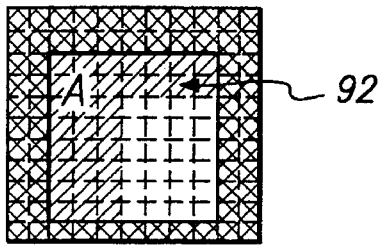

However, before the lower window is drawn, it must be modified or adjusted such that the portion of the window overlapped by the top window will not be drawn on the display. In step 70, the method maps the border of the bottom window to the device grid. Then in step 71, the border is reduced or adjusted to remove those pixels that are overlapped by the top window. Since the borders for both window are defined in global coordinates, there will not be any contention for pixels when the two borders are drawn on the screen. Next, in step 72, the visible region for the bottom window is adjusted so that the adjusted visible region 90 includes only those pixels that are not overlapped by the top window. As shown in the example of FIG. 6A, when window B is moved over window A, window A's visible region 90 is reduced by the six source pixels where window B overlaps window A. This reduced area is the adjusted visible region 90. Then in step 73, the adjusted visible region 90 of the bottom window is mapped to an adjusted visible device space region 92. As best shown in FIG. 6B, the mapping produces the device space visible region 92 that will clip any source drawing in window A to the correct device pixels. Since the adjusted visible region 90 is also defined in global coordinates, thus, any contention for pixels between the contents of the bottom window and the border of the top window is eliminated. Next, the method maps the contents of the bottom window to the device grid in step 74.

In step 75, the contents of the bottom window in the device grid units are trimmed to match the device space units that form the adjusted visible region 92. Finally, in step 76, the trimmed window contents for the bottom window are drawn on the screen. At the time window B is moved over window A, the pixels in question are owned by window A's contents. Therefore, the border for window B is re-drawn, giving it ownership of these pixels. Window A's visible region is then adjusted so that any subsequent drawing in window A is clipped to the correct pixels.

Figure 9:
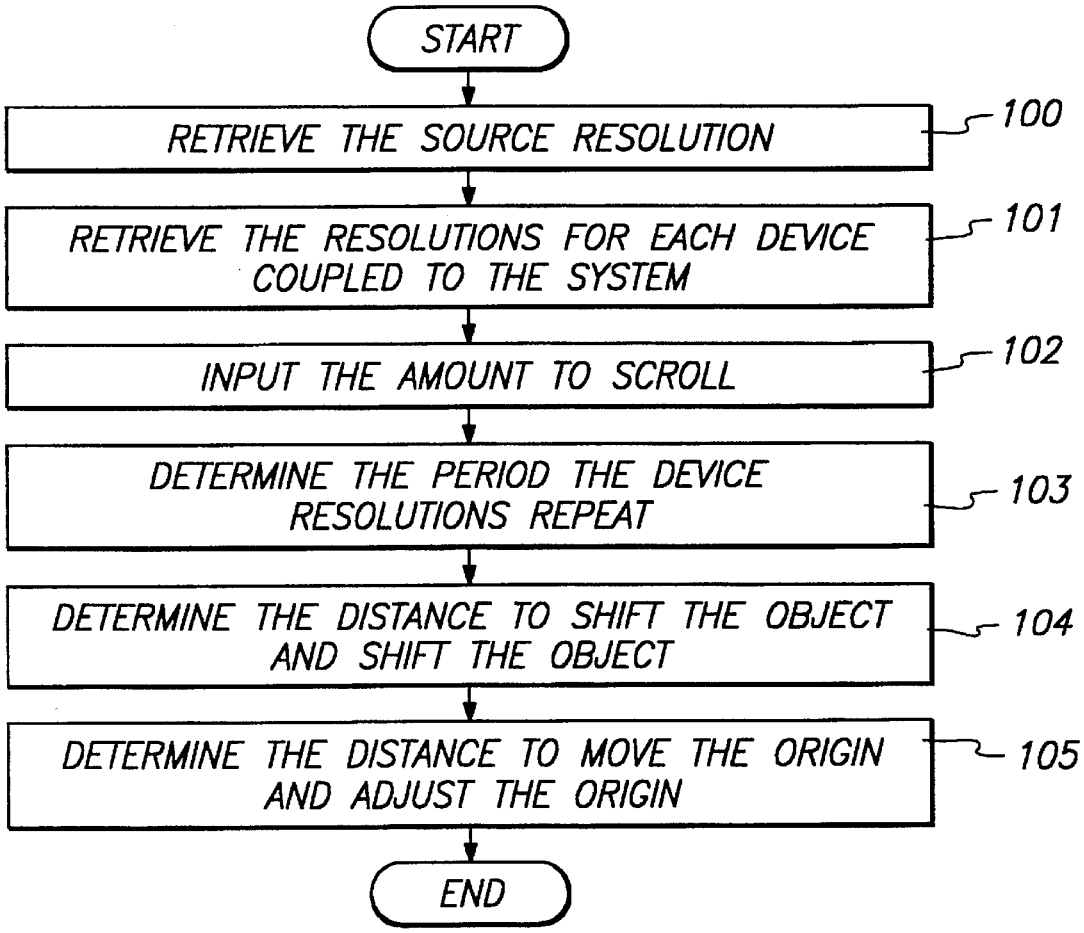
FIG. 9 is a flow chart of the preferred method for scrolling on a finite coordinate grid.

Referring now to FIG. 9, another method for improving windowing systems will be described. FIG. 9 illustrates a preferred method for resolution scrolling on a finite coordinate grid. As noted above, drawing operations are performed relative to the origin of the window. The window maintains the same device grid regardless of the window position on the device. To scroll window contents in the system of the present invention, the origin must be moved in unison with the scrolling operation. Because the origin is limited to the bounds of the coordinate space defined by the graphics system, the size of data that can be scrolled in the window is limited. The present invention eliminates this problem and maintains the integrity of the device grid for a window. This is accomplished in the present invention with a process, that provides the correct gridding for all attached devices, even if they have different resolutions.

As shown in FIG. 9, the method begins in step 100 by retrieving the source resolution in which image or contents of the window are defined. Then in step 101, the method retrieves the resolution for each device coupled to the system. Then in step 102, the amount the display is to be scrolled is input. Next in step 103, the method determines the period that the device resolutions repeat. In other words, the number of source pixels before the same point in all the device grids repeats. The period can be determined using the following equation:

Period=Source Resolution/GCD(Source Resolution, Device 1 Resolution, Device 2 Resolution . . . Device n Resolution).

In this equation, GCD is the function of finding the greatest common divisor. Once the period has been determined in step 103, the method scrolls the object such that it lies on the same grid by scrolling the object in two steps. First, the object is moved an amount that is the multiple of the period, and then the origin is offset by any remaining amount the object is to be scrolled that is less than the period. Through this two part process, the gridding for the object is maintained. In step 104, the method preferably determines the amount the object is to be shifted and then shifts the object. The process moves the object either up or down (in a direction opposite to the scroll). The amount the object is to be shifted can be determined using integer division for the scroll amount/period and multiplying by the period, or by the following equation:

Shifted units=period×Trunc (scroll amount/period).

Once the shifted units have been calculated, the object is shifted by that value. Then in step 105, the method determines the amount by which to adjust the origin to obtain the amount of scrolling input. The amount the origin is to be adjusted is determined by solving the equation:

Origin adjustment amount=Scroll amount MOD period, where MOD delineates the modulo function. In an alternate embodiment, the amount the origin is to be adjusted can also be calculated by subtracting the shifted units from the scroll amount. The method then adjusts the origin by moving the origin by the origin adjustment amount in a direction opposite from the direction the object was shifted. Thus; the object will effectively be moved by the scroll amount while retaining the same gridding. Those skilled in the art will realize that this method may also be applied to scrolling in the horizontal direction although only scrolling the vertical direction has been described.

For example, consider a system that has a 72 dpi source space where we want to scroll the object down by 155 pixels. The system is coupled to a first monitor with a device space of 128 dpi and to a second monitor with 108 dpi resolution. The period at which the device grid repeat would be:

$$\begin{aligned} \text{Period} &= 72/\text{GCD}(72, 128, 108) \\ &= 72/4 \\ &= 18. \end{aligned}$$

The object would then be shifted down by:

$$\begin{aligned} \text{Shifted units} &= 18 \times \text{Trunc}\ (155/18) \\ &= 18 \times 8 \\ &= 144 \text{ pixels.} \end{aligned}$$

And finally, the origin would be adjusted upward by:

Origin adjustment amount=155 MOD 18=11 pixels.

While the present invention has been described with reference to certain preferred embodiments, those skilled in the art will recognize that various modifications may be provided. For example, there may be other embodiments for the method of rendering resolution independent windows in addition to those described with reference to FIGS. 7 and 8. These and other variations upon and modifications to the preferred embodiment are provided for by the present invention which is limited only by the following claims.

What is claimed is:

1. A method for displaying a window on a screen of a display device that eliminates the effects of gridding, said screen having a device grid established according to a resolution of the display device, said method comprising the steps of:

defining the window as having a border, window contents, and a visible region, the border and the visible region being defined in global coordinates of a source space, and the window contents being defined in local coordinates of the source space;

mapping the window border and the visible region to the device grid;

drawing the window border on the screen;

mapping the window contents from local coordinates of the source space to the device grid to produce a map of the window contents;

trimming in device space the map of the window contents to match an area of the device grid to which the visible region was mapped; and drawing the trimmed window contents on the screen.

2. The method of claim 1, wherein the step of mapping the window border translates the window border and visible region from global coordinates of source space to device grid pixels.

3. The method of claim 1, wherein the step of mapping the window contents translates the window contents from local coordinates of source space to device grid pixels.

4. The method of claim 1, wherein the step of trimming the device grid map further comprises the substeps of:

identifying those device pixels outside the bounds of the visible region; and eliminating the identified device pixels from the map of the window contents to device pixels to create the trimmed window contents.

5. A method for displaying a plurality of windows on a screen of a display device, the method eliminating the effects of gridding, the screen having a device grid established according to a resolution of the display device, said method comprising the steps of:

defining a first window having a border being defined in a first coordinate space end window contents being defined in a second coordinate space;

defining a second window having a border defined in the first coordinate space and window contents being defined in a third coordinate space;

identifying one of the first and second windows as the top window, and the other window as the bottom window;

mapping the top window to the device grid;

drawing the top window on the screen of the display device;

defining a visible region for contents of the bottom window in the first coordinate space;

adjusting the size of the visible region by an overlap of the top window over the bottom window;

mapping the visible region and the bottom window to device space to produce a map of the visible region and a map of the bottom window;

adjusting the map of the bottom window to match the size of the map of the visible region; and drawing the adjusted map of the bottom window on the screen of the display device.

6. The method of claim 5, wherein the step of defining a first window comprises the steps of:

defining a first window border in global coordinates of source space;

defining a first visible region in global coordinates of source space; and defining a first window contents in local coordinates of source space.

7. The method of claim 6, wherein the step of mapping the top window to the device grid comprises the steps of:

mapping the border of the top window from global coordinates of source space to the device grid;

mapping the visible region of the top window from global coordinates to the device grid;

mapping the contents of the top window from local coordinates to the device grid; and trimming in device space the map of the contents of the top window to match the map of visible region.

8. The method of claim 7, wherein the step of drawing the top window on the screen comprises the steps of:

drawing the map of the border; and drawing the trimmed map of the contents of the top window.

9. The method of claim 7, wherein the step of defining a visible region for contents of the bottom window comprises the steps of:

defining a bottom window border in global coordinates of source space;

defining a bottom visible region in global coordinates of source space; and defining a bottom window contents in local coordinates of source space.

10. The method of claim 9, wherein the step of adjusting the size of the visible region comprises the steps of:

identifying the global pixels that the top window covers;

determining the global pixels that visible region of the bottom window covers;

removing the global pixels that are covered by both the top window and the bottom window from the visible region;

determining the global pixels that the bottom window border covers; and removing the global pixels that are covered by the top window from the border of the bottom window.

11. The method of claim 9, wherein the step of mapping the visible region and the bottom window to device space comprises the step of:

mapping the border of the bottom window from global coordinates of source space to the device grid;

mapping the visible region of the bottom window from global coordinates to the device grid; and mapping the contents of the bottom window from local coordinates to the device grid.

12. The method of claim 9, wherein the step of adjusting the bottom window to match the size of the visible region comprises the step of:

identifying the device pixels forming the contents of the bottom window;

determining the device pixels forming the visible region of the bottom window; and removing the device pixels that are outside the visible region from the contents of the bottom window.

13. The method of claim 5, wherein the step of defining a second window comprises the steps of:

defining a second window border in global coordinates of source space;

defining a second visible region in global coordinates of source space; and defining a second window contents in local coordinates of source space.

14. The method of claim 5, wherein the visible region for contents of the bottom window and the top window are both defined in global space.

15. The method of claim 5, wherein the step of adjusting the size of the visible region comprises the steps of:

identifying the global pixels that the top window covers;

determining the global pixels that the bottom window covers; and removing the global pixels that are covered by both the top window and the bottom window from the visible region.

* * * * *